US011692800B2

(12) United States Patent
Winblad et al.

(10) Patent No.: US 11,692,800 B2
(45) Date of Patent: Jul. 4, 2023

(54) SAFETY AND ARMING UNIT

(71) Applicant: Saab Dynamics AB, Linköping (SE)

(72) Inventors: Gunnar Winblad, Linköping (SE); Simon Skjöld, Linköping (SE); Ernst Olivier Schneider, Linköping (SE); Sören Ohlsson, Linköping (SE)

(73) Assignee: Saab Dynamics AB, Linköping (SE)

( * ) Notice: Subject to any disclaimer, the term of this patent is extended or adjusted under 35 U.S.C. 154(b) by 54 days.

(21) Appl. No.: 17/436,273

(22) PCT Filed: Mar. 3, 2020

(86) PCT No.: PCT/EP2020/055582
§ 371 (c)(1),
(2) Date: Sep. 3, 2021

(87) PCT Pub. No.: WO2020/178292
PCT Pub. Date: Sep. 10, 2020

(65) Prior Publication Data

US 2022/0178668 A1 Jun. 9, 2022

(30) Foreign Application Priority Data

Mar. 4, 2019 (EP) ..... 19446501

(51) Int. Cl.
*F42C 15/00* (2006.01)
*F42C 11/00* (2006.01)
(Continued)

(52) U.S. Cl.
CPC ..... *F42C 15/005* (2013.01); *F42C 11/005* (2013.01); *F42C 14/045* (2013.01);
(Continued)

(58) Field of Classification Search
CPC ..... F42C 11/005; F42C 15/005; F42C 15/29; F42C 15/32; F42C 15/34; F42C 15/44; F42C 14/045; F42B 33/06
See application file for complete search history.

(56) References Cited

U.S. PATENT DOCUMENTS 3,195,460 A * 7/1965 Kalaf ..... F42C 5/00 102/420
3,532,057 A * 10/1970 Aubrey ..... F42C 14/04 102/229
(Continued)

FOREIGN PATENT DOCUMENTS

EP 0075496 A1 3/1983

OTHER PUBLICATIONS

PCT International Search Report and Written Opinion dated Jun. 8, 2020 for Intl. App. No. PCT/EP2020/055582, from which the instant application is based, 10 pgs.

*Primary Examiner* — Joshua E Freeman
(74) *Attorney, Agent, or Firm* — Fredrikson & Byron, P.A.

(57) ABSTRACT

The present invention relates to a safety and arming unit for initiation of underwater charges, comprising: a housing; a detonator; an interrupter slidable within the housing from a first position in which a firing chain from the detonator to a charge is interrupted, to a second position, in which the firing chain is complete; a first member configured to cooperate with the housing and the interrupter to form a first interlock, wherein, upon the first member being in a first position, said interlock locks said interrupter in said first position, and upon the first member being in a second position, said interrupter is free to slide relative to said first member; a second member configured to cooperate with the housing and the interrupter to form a second interlock, mechanically independent of said first interlock, wherein,
(Continued)

upon the second member being in a first position, the interlock locks said interrupter in said first position, and upon the second member being in a second position, said interrupter is free to slide relative to said second member; and a plurality of electrical switches arranged in series, switchable from a first configuration in which the detonator is electrically isolated from a remote initiation firing system, to a second configuration in which the detonator is in electrical communication with a remote initiation firing system; wherein, upon the first member being in the second position, and the second member being in the second position, the interrupter is slidable from the first position to the second position upon being subjected to an external water pressure of at least a predefined threshold value. Upon the interrupter being in the second position, the interrupter acts on the plurality of electrical switches to switch said plurality of switches to said second configuration.

16 Claims, 14 Drawing Sheets

(51) Int. Cl.
*F42C 14/04* (2006.01)
*F42C 15/29* (2006.01)
*F42C 15/32* (2006.01)
*F42C 15/34* (2006.01)
*F42C 15/44* (2006.01)
*F42B 33/06* (2006.01)

(52) U.S. Cl.
CPC ..... *F42C 15/29* (2013.01); *F42C 15/32* (2013.01); *F42C 15/34* (2013.01); *F42C 15/44* (2013.01); *F42B 33/06* (2013.01)

(56) References Cited

U.S. PATENT DOCUMENTS 3,782,282 A * 1/1974 Bjork ..... F42C 19/06 102/420
4,111,125 A * 9/1978 Reineke ..... F42C 14/045 102/411
4,986,184 A * 1/1991 Kude ..... F42C 15/184 102/247
5,821,447 A * 10/1998 Reams ..... F42C 14/045 89/1.55
6,131,516 A * 10/2000 Sanford ..... F42C 15/44 102/229
6,173,650 B1 * 1/2001 Garvick ..... F42C 15/34 102/202.4

* cited by examiner

SAFETY AND ARMING UNIT

RELATED APPLICATIONS

This application is a 35 U.S.C. 371 national stage filing from International Application No. PCT/EP2020/055582, filed Mar. 3, 2020, which claims priority to European Application No. 19446501.9, filed Mar. 4, 2019, the teachings of which are incorporated herein by reference.

The present invention relates to a safety and arming unit for initiation of underwater charges. In particular, the present invention relates to a safety and arming unit for initiation of underwater charges suitable for underwater ordnance, such as mines, clearance.

Underwater ordnance disposal systems are known. For example, traditional mine sweeping vessels drag either lines to mechanically trigger the ordnance or a decoy to remotely trigger the ordnance for example by simulating the magnetic or acoustic signature of a vessel being targeted by the ordnance. This type of mine sweeping is dangerous as it requires the vessel to enter the area containing the ordnance. In addition, unsweepable ordnance has been developed which prevents the use of such a system.

Other types of ordnance disposal systems are known, and enable remote, i.e. remote from a vessel such as a mine countermeasures vessel (MCMV), operation. Examples of such known systems are diver placed charges, remotely operated single charge systems, and multiple charge deployment systems.

Also known are means for ensuring that the clearance charge is safe to handle, and only placed in an armed state after certain operations have been carried out, and only in certain conditions. For example, hydrostatic arming units are well-known, which only arm the clearance charge upon the clearance charge being below a certain depth of water. Other more complex safety and arming units are known, such as that disclosed in EP 0 075 496 A1. The system of EP 0 075 496 A1 comprises a movable rotor which forms a screen across a pyrotechnic firing chain, the rotor being locked by a shaft movable under the influence of external water pressure. Movement of the shaft initiates an inter-related chain of events that results in the arming of the charge device.

It is therefore an object of the present invention to provide an improved safety and arming unit. It may also an object of the present invention to provide a safety and arming unit that complies with the requirements of AOP-15 (third edition) and AOP-16 (fourth edition).

According to a first aspect of the present invention, there is provided a safety and arming unit for initiation of underwater charges, comprising: a housing; a detonator; an interrupter slidable within the housing from a first position in which a firing chain from the detonator to a charge is interrupted, to a second position, in which the firing chain is complete; a first member configured to cooperate with the housing and the interrupter to form a first interlock, wherein, upon the first member being in a first position, said interlock locks said interrupter in said first position, and upon the first member being in a second position, said interrupter is free to slide relative to said first member; a second member configured to cooperate with the housing and the interrupter to form a second interlock, mechanically independent of said first interlock, wherein, upon the second member being in a first position, the interlock locks said interrupter in said first position, and upon the second member being in a second position, said interrupter is free to slide relative to said second member; and a plurality of electrical switches arranged in series, switchable from a first configuration in which the detonator is electrically isolated from a remote initiation firing system, to a second configuration in which the detonator is in electrical communication with a remote initiation firing system. Upon the first member being in the second position, and the second member being in the second position, the interrupter is slidable from the first position to the second position upon being subjected to an external water pressure greater than a threshold value. Upon the interrupter being in the second position, the interrupter acts on the plurality of electrical switches to switch said plurality of switches to said second configuration.

Advantageously, by providing a system having a plurality of safety features, in the form of a removable pin, first and second locks and a plurality of switches arranged in series, each released, triggered or activated by independent events, a safety and arming unit which reduces the risk of accidental arming and firing is provided.

Preferably, the threshold value is about 3 mwc, but may be any suitable value, such as 6 mwc, 10 mwc, or 20 mwc depending on the requirements of the particular use case for the safety and arming unit. Preferably, the interrupter is resiliently biased towards the first position. The threshold value is preferably determined by the stiffness of the resilient biasing means. The resilient biasing means is preferably a spring, more preferably a helical spring. The housing preferably further comprises a diaphragm configured to form a seal between an end of the interrupter and the housing. The, flexible, diaphragm is configured to maintain the seal between the interrupter and the housing upon relative movement between the two.

Preferably, the safety and arming unit further comprises a mechanical actuator configured to move said first member from said first position to said second position, more preferably said mechanical actuator comprises a lever, pivoted about a fulcrum on said housing. The lever is preferably configured as a cam lever, the cam surface acting on the first member. The first member is preferably configured to slide linearly, and preferably perpendicularly to, the interrupter.

The first member preferably has a first end and a second end. The first end being configured to be acted upon by said lever, the second end comprising at least one projection. In this embodiment, the interrupter comprises an elongate slot and corresponding protrusion configured to partially cover the slot. The slot and protrusion preferably having a cross-sectional shape substantially corresponding to the cross-sectional shape of the second end of the first member. The protrusion comprising at least one notch configured to engage with the at least one projection of the second end of the first member to lock the interrupter in its first position upon the first member being in its first position.

In one example, the second end of the first member comprises a circular projection configured such that the second end is in the form of a T-piece, the elongate slot and protrusion being a T-groove. Alternatively, the second end of the first member comprises two opposed projections configured such that the second end is in the form of a T-piece, the elongate slot and protrusion being a T-groove. Further examples, such as a single elongate projection may be provided at the second end of the first member such that the second end is in the form of a L-piece, the elongate slot and protrusion having a corresponding shape. In each example, the at least one notch in the protrusion partially covering the slot preferably has a shape corresponding to the shape of the second end of the first member.

Preferably, the safety and arming unit further comprises a line having a first end releasably coupled to said mechanical actuator, and a second end configured to be coupled to a deployment device configured to deploy an underwater charge coupled to the safety and arming unit. In this way, the mechanical actuator may be configured to move said first member from the first position to the second position upon release and separation of the underwater charge coupled to the safety and arming unit from the deployment device. Preferably, the line is in the form of a lanyard. In one example, the mechanical actuator comprises a recess, preferably in the form of a notch, configured to receive a loop provided on the line, to releasably couple the line to the actuator. The line may be between about 300 mm and about 1500 mm in length, preferably between about 500 mm and about 1000 mm in length.

Preferably, said first member is retained in said first position by a detent. The detent is preferably a frangible member. In this way, the safety and arming unit may provide a reduced risk of unintentional arming. The frangible member is preferably a shear-pin, preferably formed of Brass, or Aluminium. Alternatively, the detent comprises at least one resiliently biased pin configured to engage with a corresponding recess in the housing, the at least one pin being biased towards engagement with said recess. The or each pin preferably has a rounded end configured to engage with the recess, the recess having a corresponding shape. The detent may comprise two such resiliently biased pins, provided on opposed sides of the first member. The detent may comprise four such resiliently biased pins, provided orthogonal to each other about the first member. As will be appreciated, the force required to overcome the biasing force to release the or each pin from the or each recess is equivalent to the force required to break the frangible member described above.

Preferably, the safety and arming unit further comprises an electrically actuated actuator configured to move said second member from said first position to said second position, preferably said electrically actuated actuator is a pyrotechnic piston actuator.

The second member is preferably configured to slide linearly, and preferably perpendicularly to, the interrupter. The first member and second member are preferably arranged such that the vector defining movement of the first member is not aligned with the vector defining movement of the second member. Preferably, the first member is provided on a side of the interrupter opposite to a side where the second member is provided, the first member and the second member being arranged such that the direction of movement from the first position to the second position is substantially radial towards the longitudinal axis of the interrupter. Advantageously, this reduces the risk that external forces acting on the safety and arming unit cause both the first member and second member to move from the first position to the second position.

The second member preferably has a first end and a second end. The first end being configured to be acted upon by said electrically actuated actuator, the second end comprising at least one projection. In this embodiment, the interrupter comprises a further elongate slot and corresponding protrusion configured to partially cover the slot. The slot and protrusion preferably having a cross-sectional shape substantially corresponding to the cross-sectional shape of the second end of the second member. The protrusion comprising at least one notch configured to engage with the at least one projection of the second end of the second member to lock the interrupter in its first position upon the second member being in its first position.

In one example, the second end of the second member comprises a circular projection configured such that the second end is in the form of a T-piece, the further elongate slot and protrusion being a T-groove. Alternatively, the second end of the second member comprises two opposed projections configured such that the second end is in the form of a T-piece, the further elongate slot and protrusion being a T-groove. Further examples, such as a single elongate projection may be provided at the second end of the second member such that the second end is in the form of a L-piece, the further elongate slot and protrusion having a corresponding shape. In each example, the at least one notch in the protrusion partially covering the slot preferably has a shape corresponding to the shape of the second end of the second member.

Preferably, said second member is retained in said first position by a further detent. The further detent is preferably a frangible member. In this way, the safety and arming unit may provide a reduced risk of unintentional arming. The frangible member is preferably a shear-pin, preferably formed of Brass, or Aluminium. Alternatively, the further detent comprises at least one resiliently biased pin configured to engage with a corresponding recess in the housing, the at least one pin being biased towards engagement with said recess. The detent may comprise two such resiliently biased pins, provided on opposed sides of the second member. The detent may comprise four such resiliently biased pins, provided orthogonal to each other about the second member. As will be appreciated, the force required to overcome the biasing force to release the or each pin from the or each recess is equivalent to the force required to break the frangible member described above.

Preferably, the safety and arming unit further comprises at least one controller, the or each controller comprising an arming timer configured to output an arming signal after a predetermined period of time, wherein said arming timer is initiated upon the first member being moved to said second position, the arming signal being configured to actuate the electrically actuated actuator. The predetermined period of time may be between about 5 minutes and about 30 minutes, preferably between about 10 minutes and about 20 minutes. In one particular embodiment, the predetermined period of time is about 15 minutes. Advantageously, providing a delay between movement of the first member to said second position, and actuating the electrically actuated actuator to move the second member to said second position, may provide increased safety and enable sufficient time for a deployment vehicle to withdraw to a safe distance before the interrupter may move to the second position to complete the firing chain. The safety and arming unit may comprise two such controllers, each comprising an arming timer configured to output an arming signal after a predetermined period of time. Each controller is preferably configured to be independent of the other. In this way, a safety and arming unit is provided which has in-built redundancy to decrease the failure rate of the unit.

The safety and arming unit preferably comprises a timer initiation electrical switch configured to be switched upon movement of the first member from the first position to the second position. The timer initiation electrical switch is preferably a micro-switch.

Preferably, said plurality of electrical switches are configured in at least two sets, the sets being disposed about the longitudinal axis of the interrupter. The two sets of switches preferably being disposed orthogonally about the longitudinal axis of the interrupter. In this way, the risk of accidental actuation of all switches due to impact forces, vibrational forces, etc, may be reduced. In the first configuration, at least one electrical switch is preferably configured to short-circuit firing leads for the detonator. In the first configuration, at least one electrical switch, preferably two electrical switches, are preferably configured to electrically connect a remote initiation firing system to electrical ground.

Preferably, each set of electrical switches comprises two electrical switches. For ease of reference, the following nomenclature will be used: the first set comprises electrical switch S1 and electrical switch S3, and the second set comprises electrical switch S2 and electrical switch S4. In one example, in the first configuration, one electrical switch, S1, from the first set and one electrical switch, S2, from the second set are each configured to electrically connect one of two electrical lines of a remote initiation firing system to electrical ground. In the second configuration, a first electrical line of a remote initiation firing system is electrically connected to the detonator by electrical switches S1 and S3 in series, and a second electrical line of a remote initiation firing system is electrically connected to the detonator by electrical switches S2 and S4 in series.

The safety and arming unit preferably further comprises at least one electrical filter connected to the plurality of electrical switches, such that upon connection to a remote initiation firing system the signals received from said remote initiation firing system are filtered. Preferably, the at least one electrical filter is a low-pass filter, more preferably the electrical low-pass filter is a Pi-filter.

Preferably, the safety and arming unit further comprises a removable pin configured to engage with the housing and the interrupter to lock said interrupter in said first position. The safety and arming unit may further comprise a positively buoyant body flexibly coupled to said removable pin. The positively buoyant body being sufficiently positively buoyant such that upon deployment of the safety and arming unit coupled to a clearance charge the positively buoyant body acts to remove said removable pin and unlock said interrupter. The safety and arming unit may further comprise a further removable pin configured to engage with the housing and the positively buoyant body to lock said positively buoyant body to said housing during transport. The positively buoyant body is preferably a float formed of rigid foam, a substantially hollow body formed of a plastic, or polyethylene.

Preferably, the safety and arming unit further comprises at least one removable transport pin configured to engage with the housing and the interrupter to lock said interrupter in said first position. The removable transport pin may comprises a highly visible tag. The removable transport pin may be removed prior to deployment of the safety and arming unit, and may reduce the risk of unintentional arming yet further.

Preferably, the safety and arming unit further comprises a sterilisation system configured to permanently lock said interrupter in a sterilised position in which a firing chain from the detonator to a charge is interrupted, said sterilisation system comprising: a sterilisation timer configured to initiate the sterilisation system after a predetermined period of time; means to move the interrupter from said second position to said sterilised position; and a lock configured to cooperate with the housing and the interrupter to lock said interrupter in said sterilised position. Where the safety and arming unit comprises at least one controller, the or each controller further comprises a sterilisation timer. The sterilisation timer may be the same timer as the arming timer, or it may be a separate timer. The predetermined period of time before initiating the sterilisation system may be between about 1 hour and about 12 hours, preferably between about 3 hours and about 9 hours, and in one preferred embodiment the period of time is about 6 hours.

Preferably, said means to move the interrupter comprises an electrically actuated gas generator. The electrically actuated gas generator is preferably sealed within the housing adjacent an end of the interrupter. The gas generator is preferably configured to generate a pressure within the housing of at least about 100 mwc, or at least about 200 mwc, or at least about 500 mwc. In one preferred embodiment, the safety and arming unit is designed for a maximum operational depth of 300 m, and so the gas generator is configured to generate a pressure within the housing of at least about 350 mwc. As will be appreciated, the pressure generate by the gas generator is chosen in dependence on the operational depth of the safety and arming unit. Where the interrupter is resiliently biased towards the first position, the gas generator is configured to cooperate with said resilient biasing to move said interrupter against the external water pressure.

Preferably, said sterilisation lock comprises a sprung clip, configured to engage with a through hole in the housing. The sterilisation lock may further comprise at least one pin, provided in said housing, resiliently biased towards said interrupter, the interrupter comprising a corresponding recess configured to receive said pin upon said interrupter being in said sterilised position. The at least one pin is preferably movable in a direction perpendicular to the longitudinal axis of the interrupter. The lock may comprise two, or more, such pins.

Preferably, the safety and arming unit further comprises: first indicia configured to indicate that the interrupter is in the first position; and second indicia configured to indicate that the interrupter is in the second position. When the safety and arming unit comprises a sterilisation system, the unit preferably further comprises third indicia configured to indicate that the interrupter is in the sterilised position. The indicia are preferably in the form of at least one of: colour; numerals; letters; and symbols. In one example, the first indicia is green, and/or the letter "S", the second indicia is red, and/or the letter "A", and the third indicia is yellow.

As used herein, the term interrupted explosive train, or interrupted firing chain, is an explosive train in which the explosive path between the detonator and the primary explosive charge is functionally separated until arming. This configuration prevents the detonation wave propagating from the detonator to the primary explosive charge even if the detonator should function.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 1:
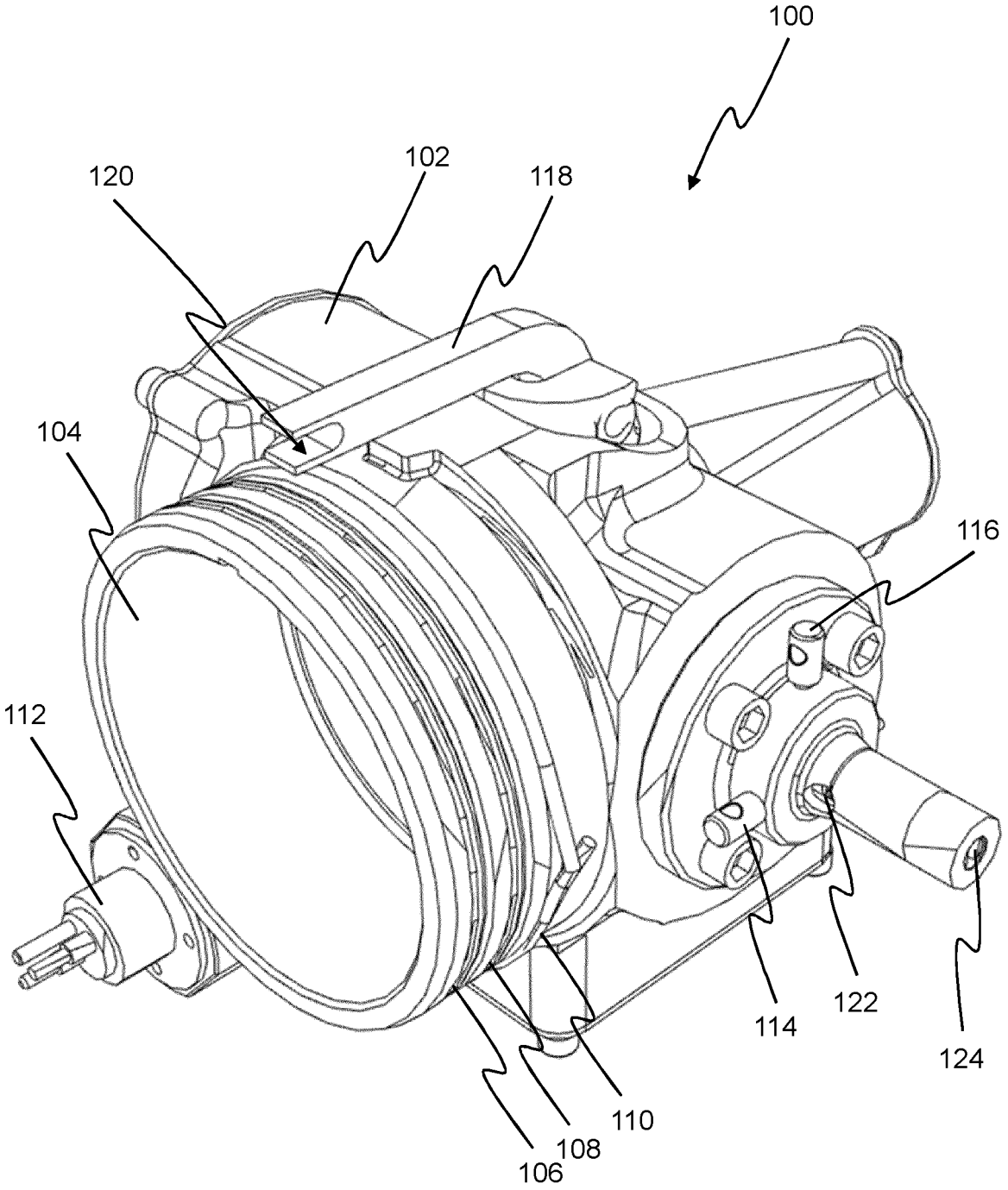
FIG. 1 shows a perspective view of a safety and arming unit according to the present invention.
Figure 6A:
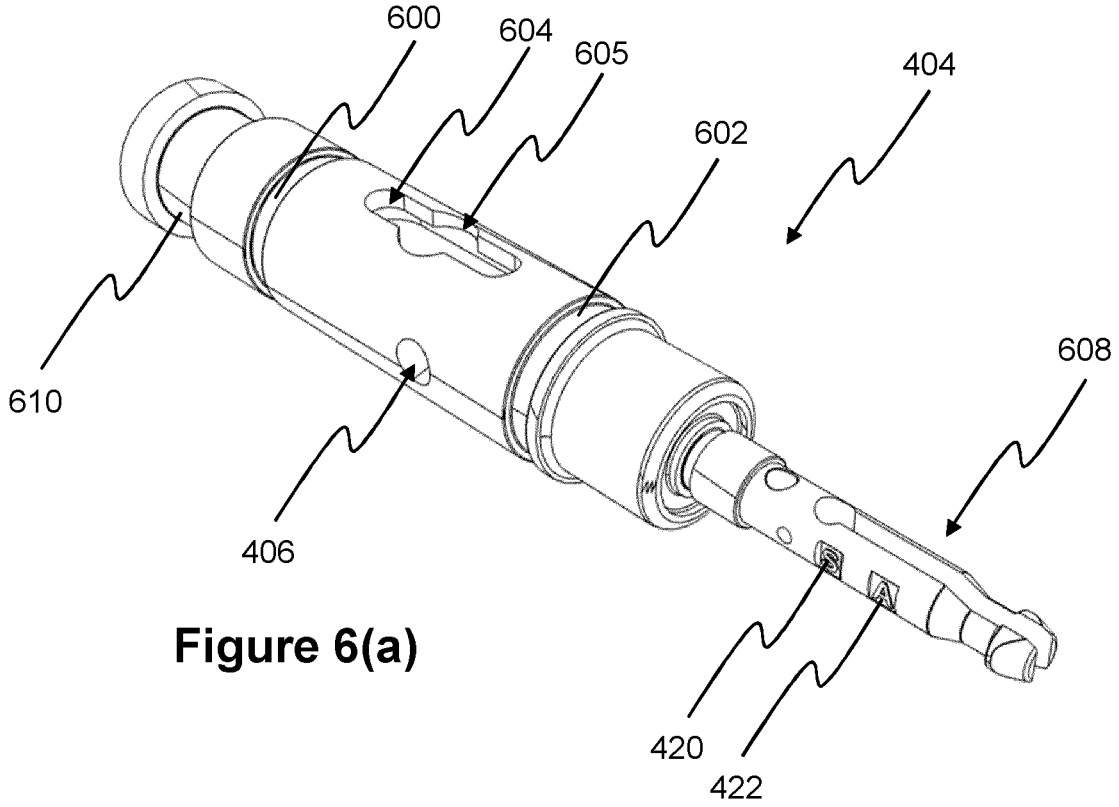
Figure 6B:
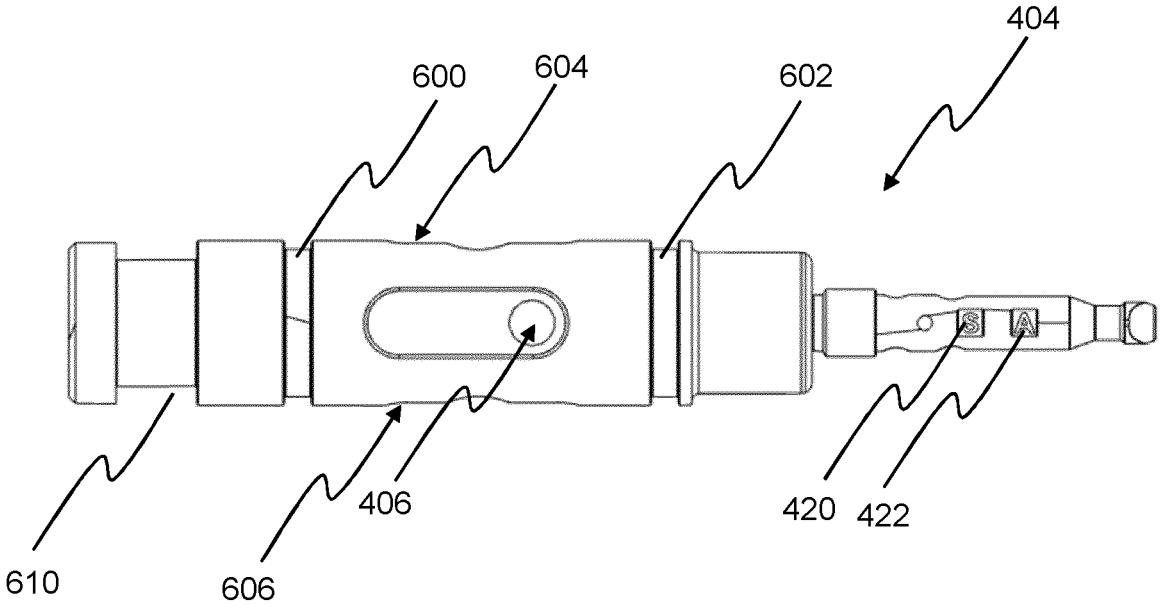
Figure 7:
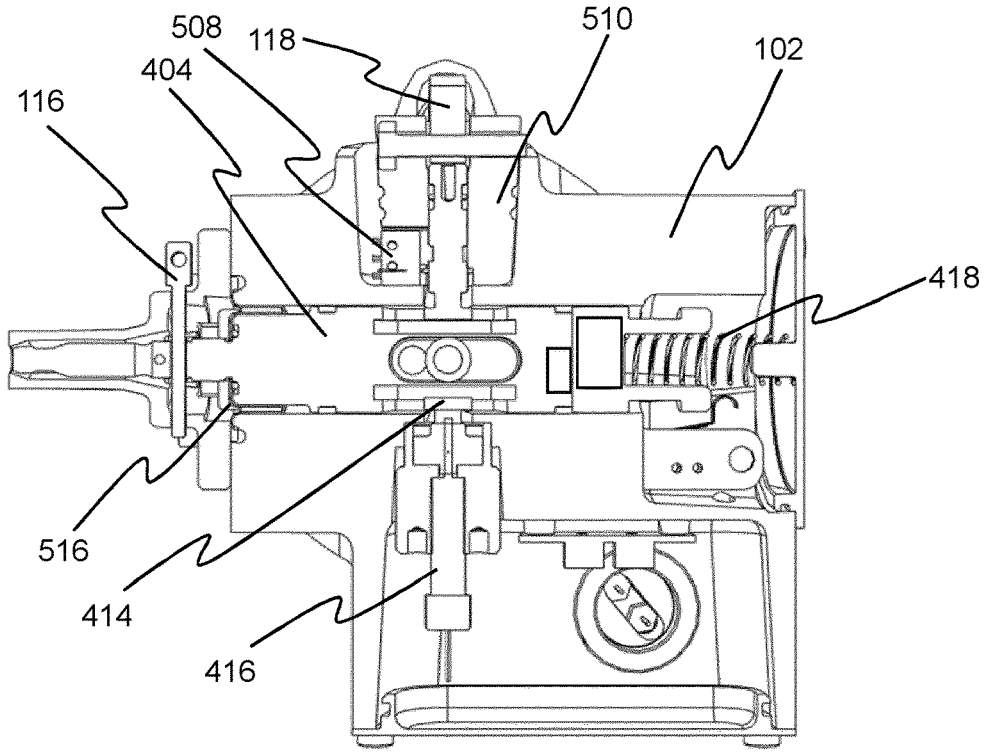
Figure 8:
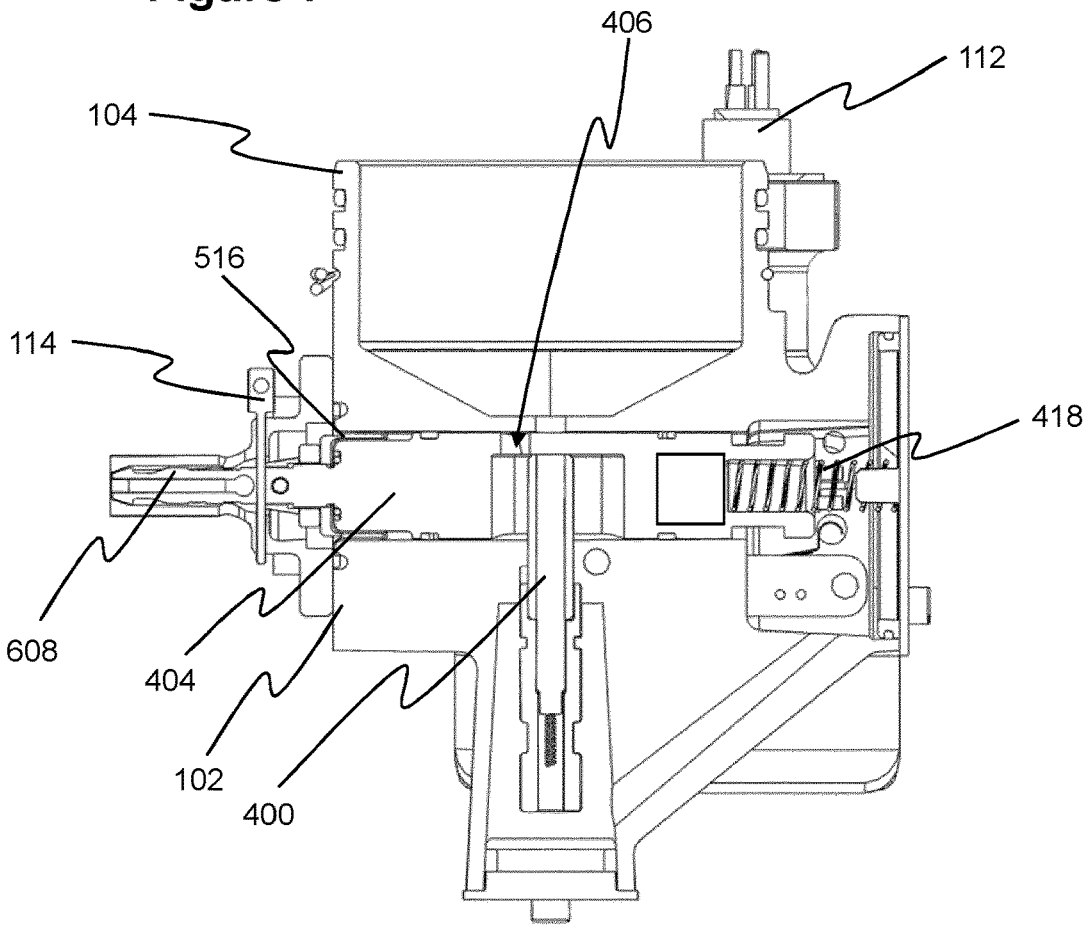
Figure 9:
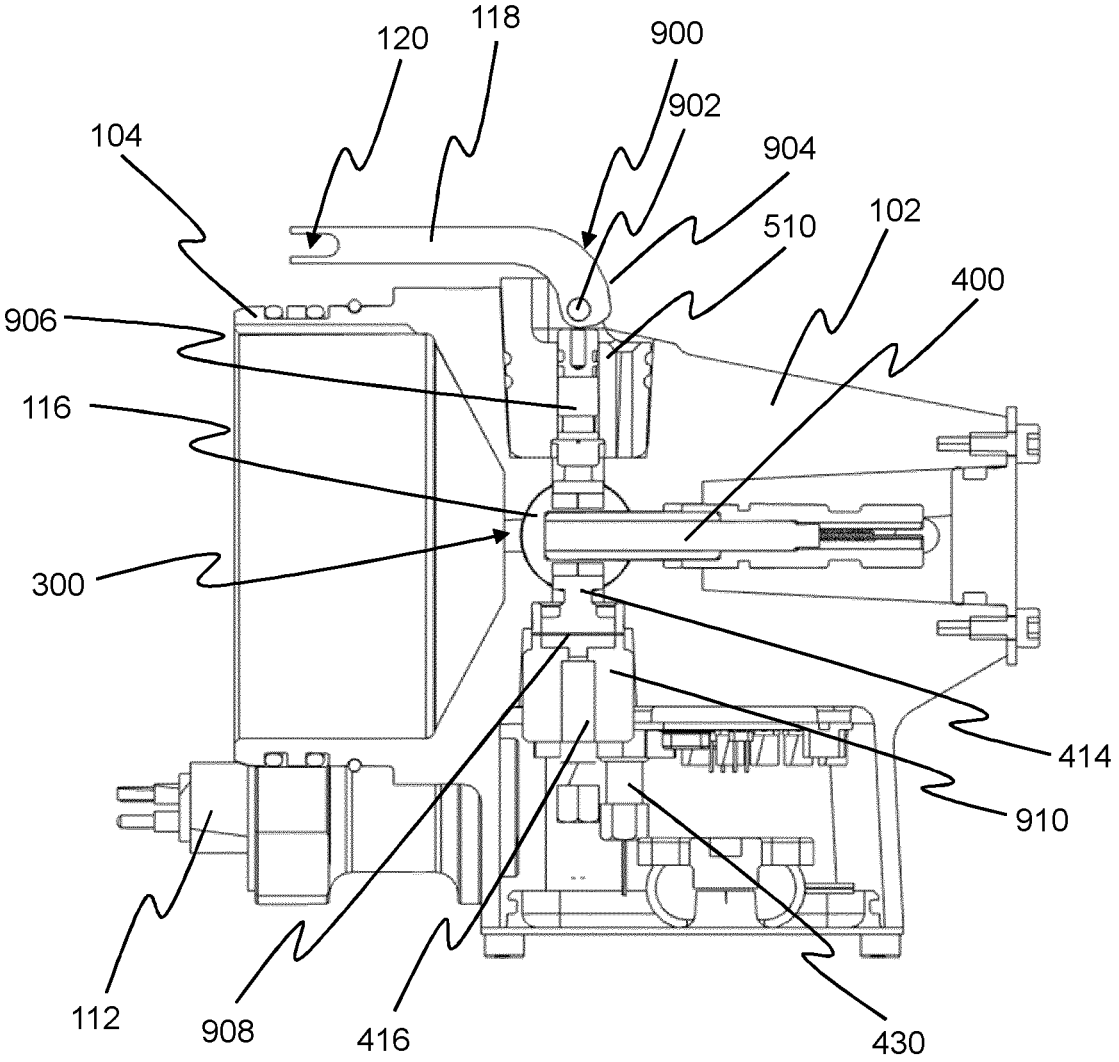
Figure 10:
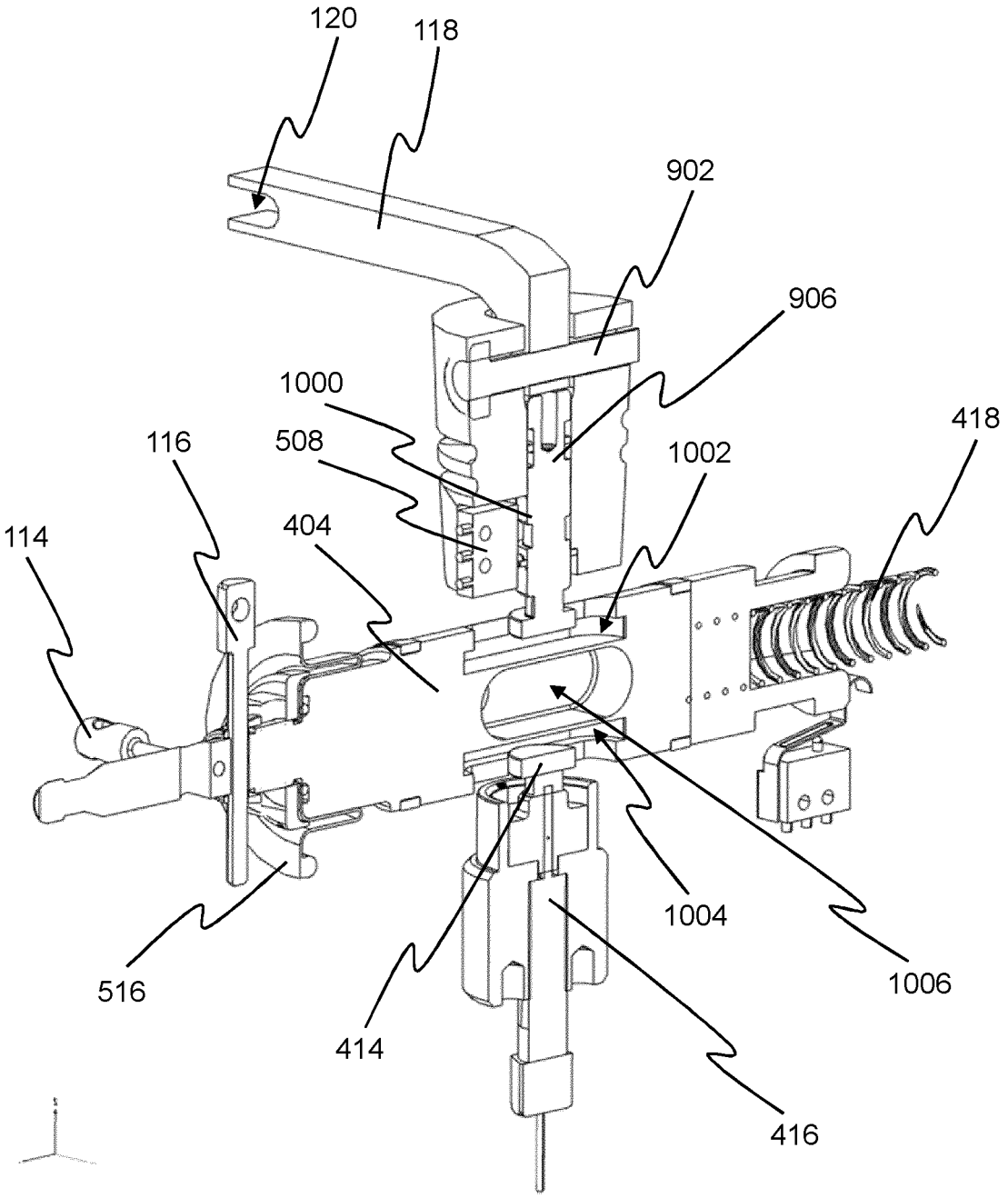
Figure 11:
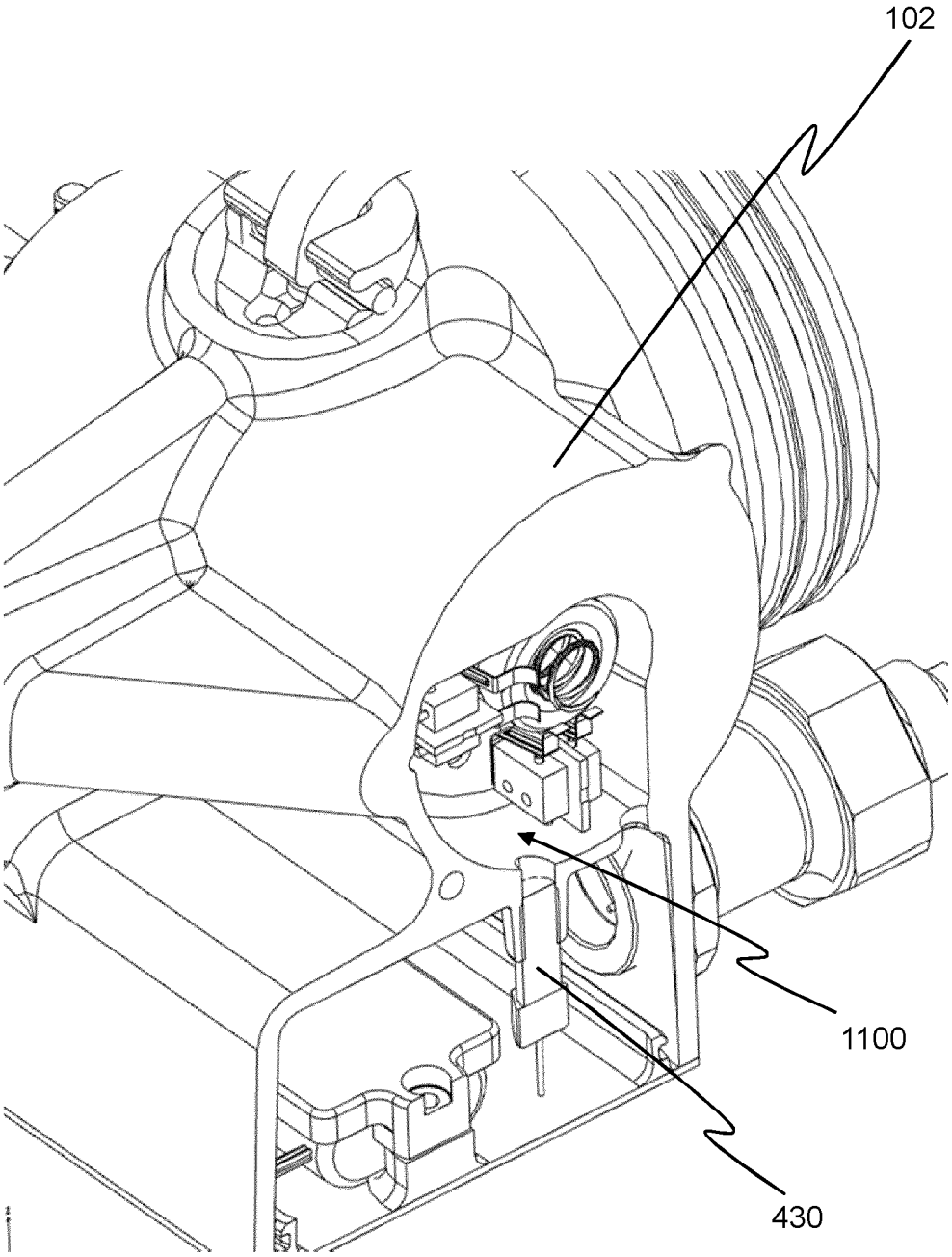
Figure 12:
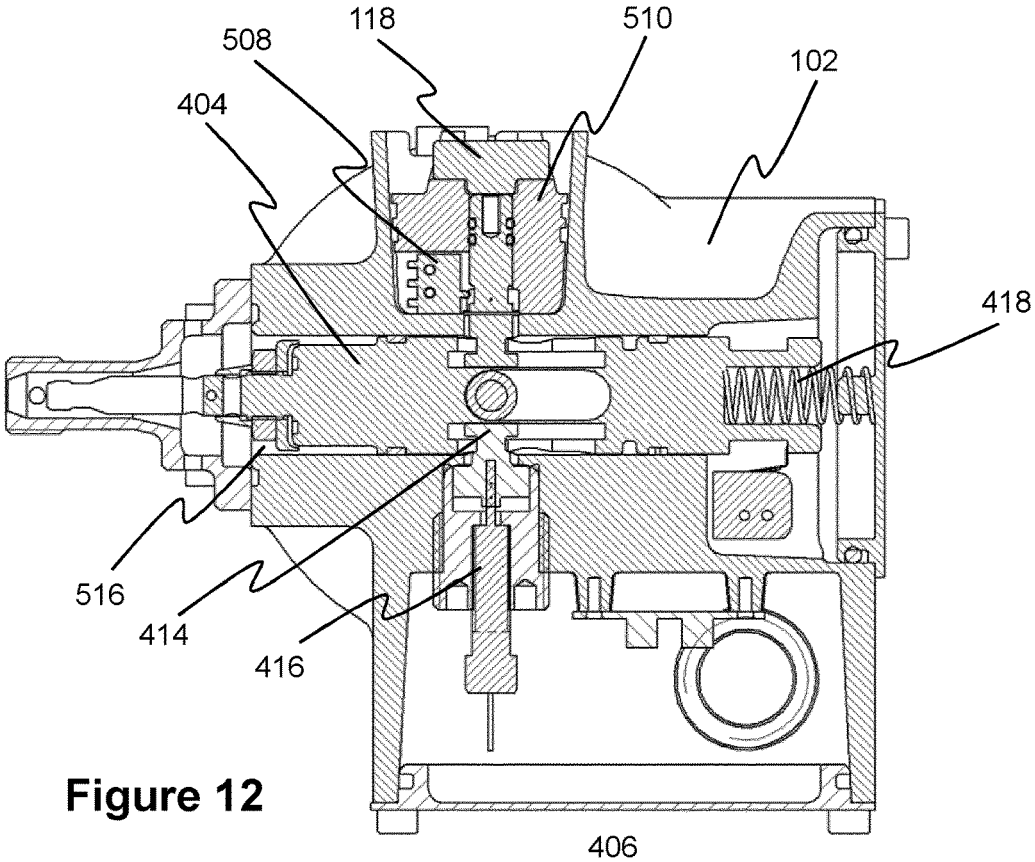
Figure 13:
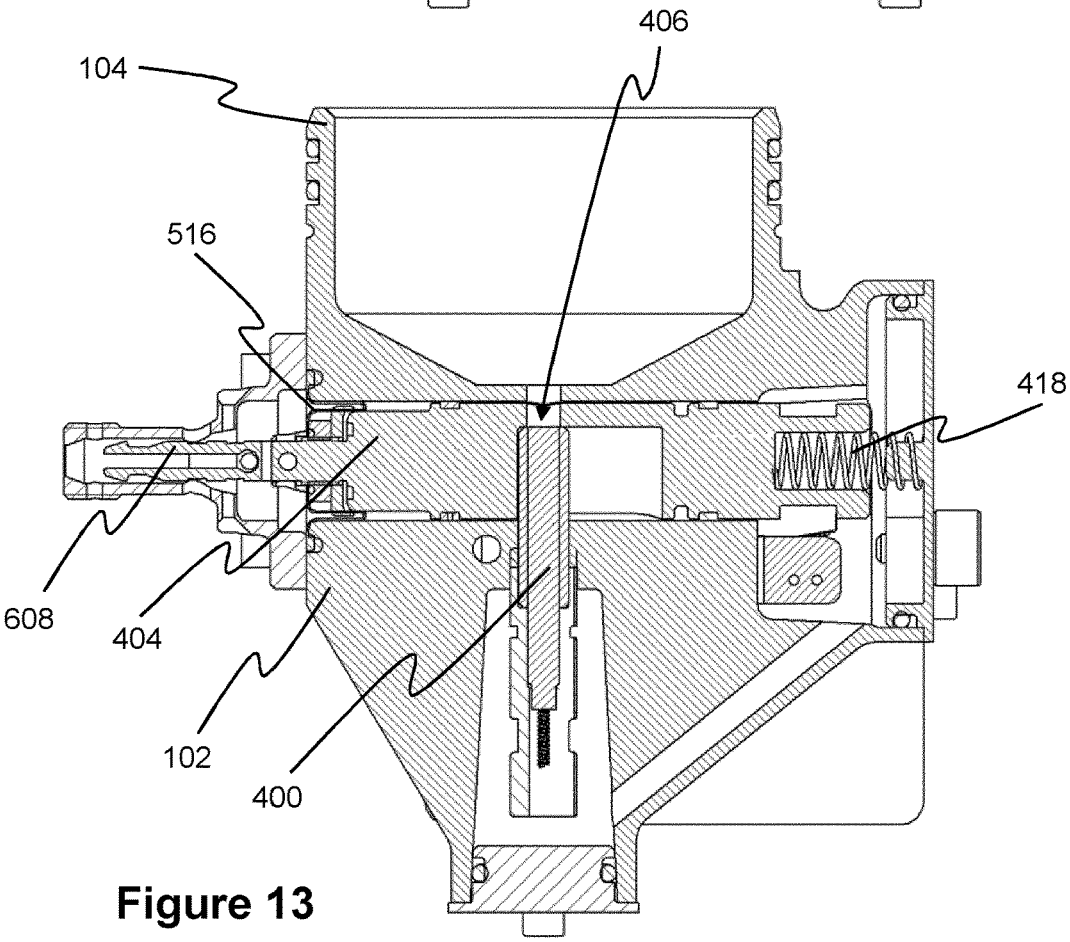
Figure 14:
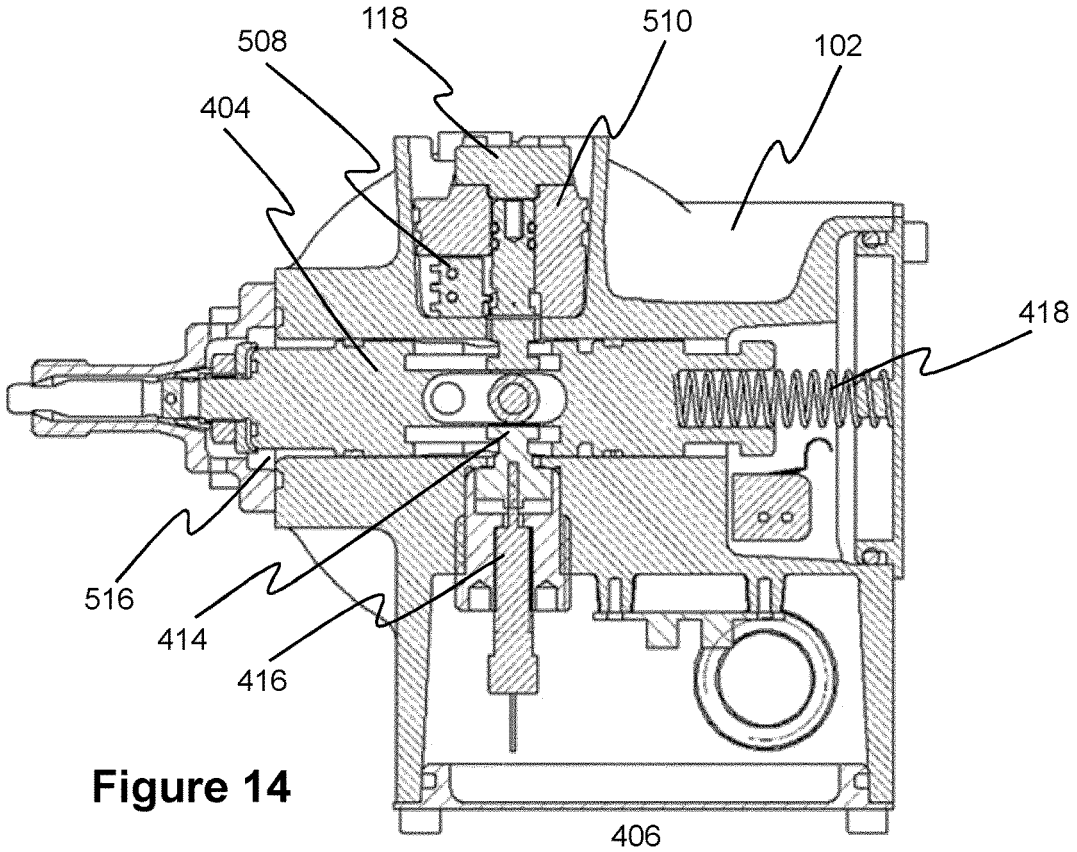
Figure 15:
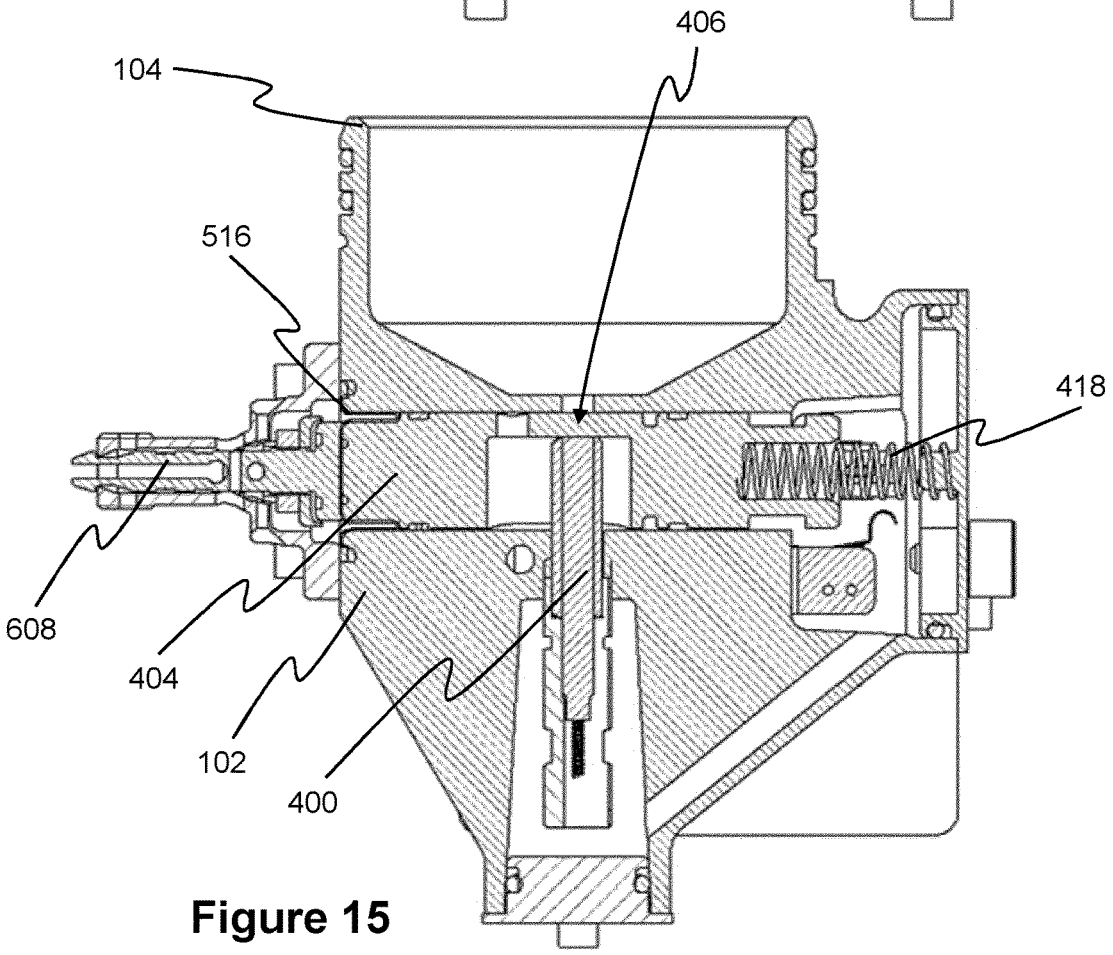
Figure 16:
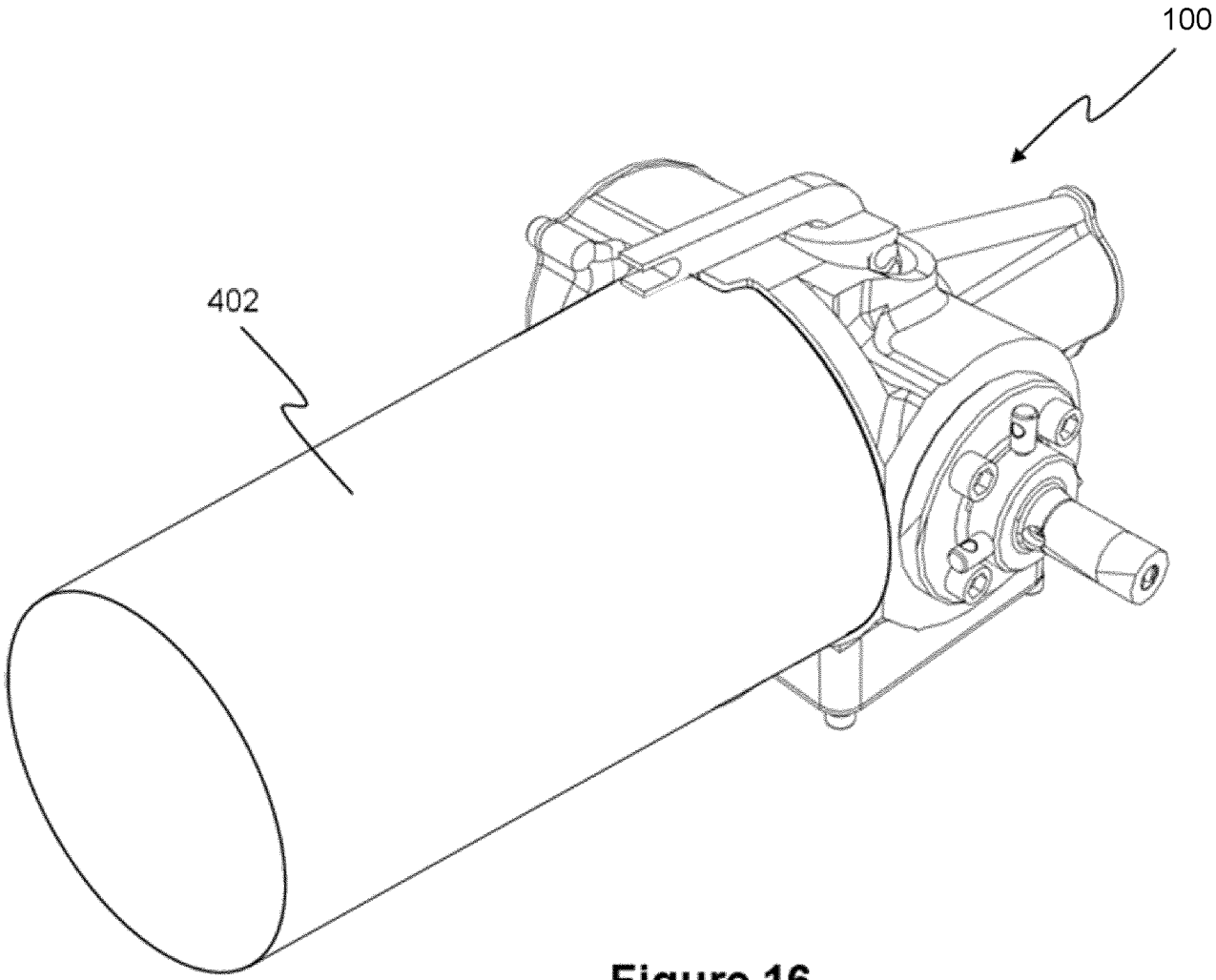
Figure 17:
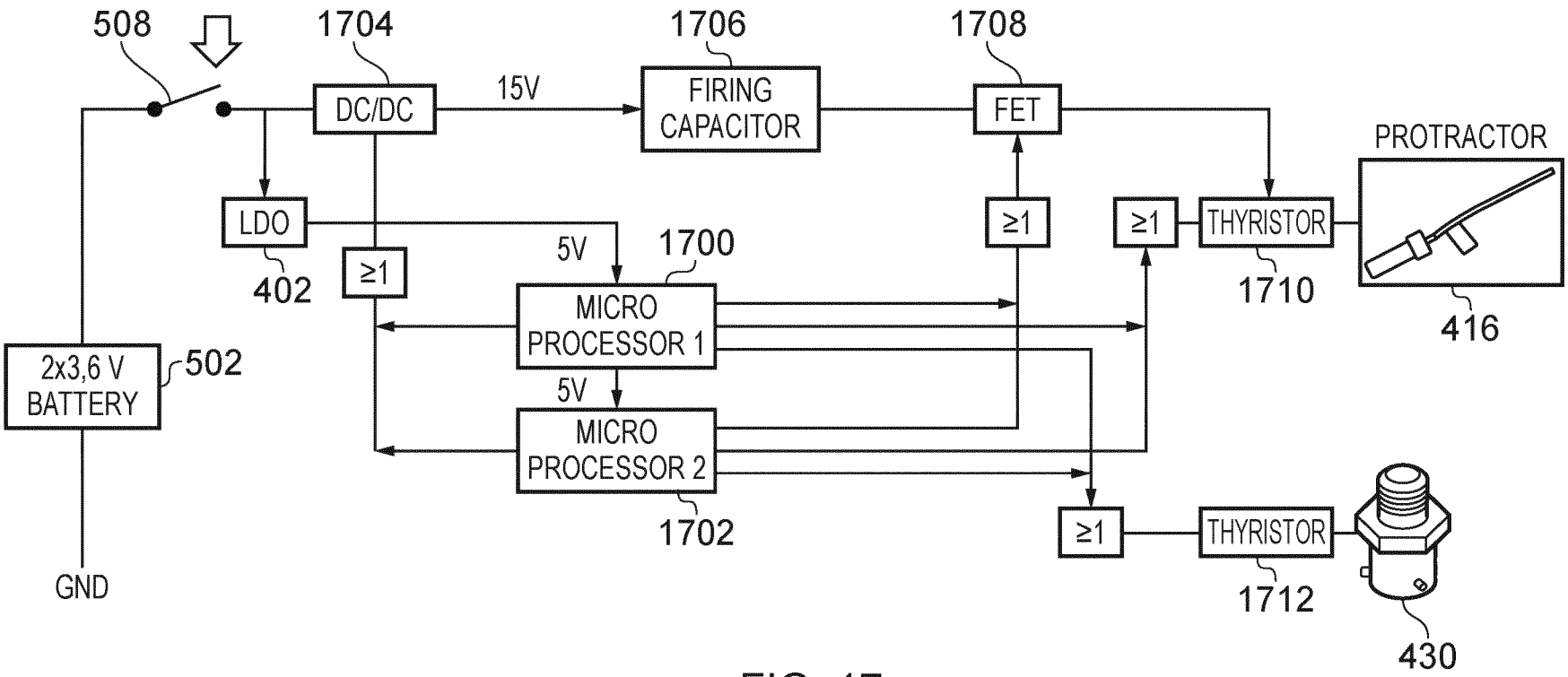
Figure 18B:
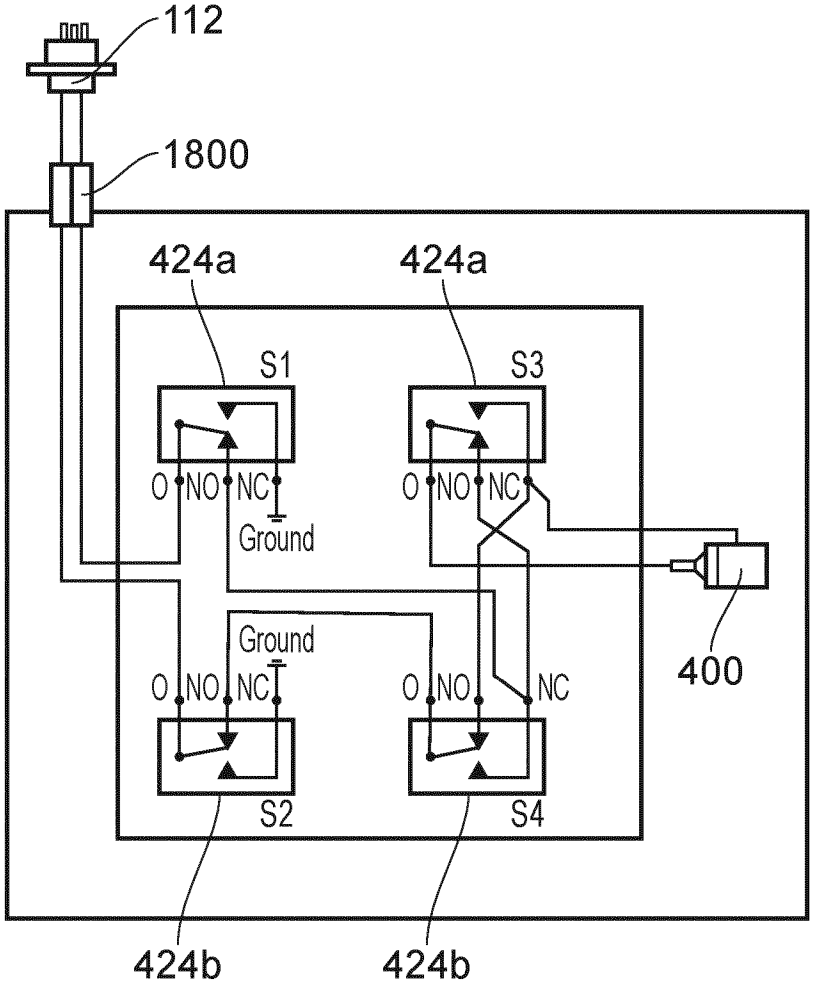
Figure 18A:
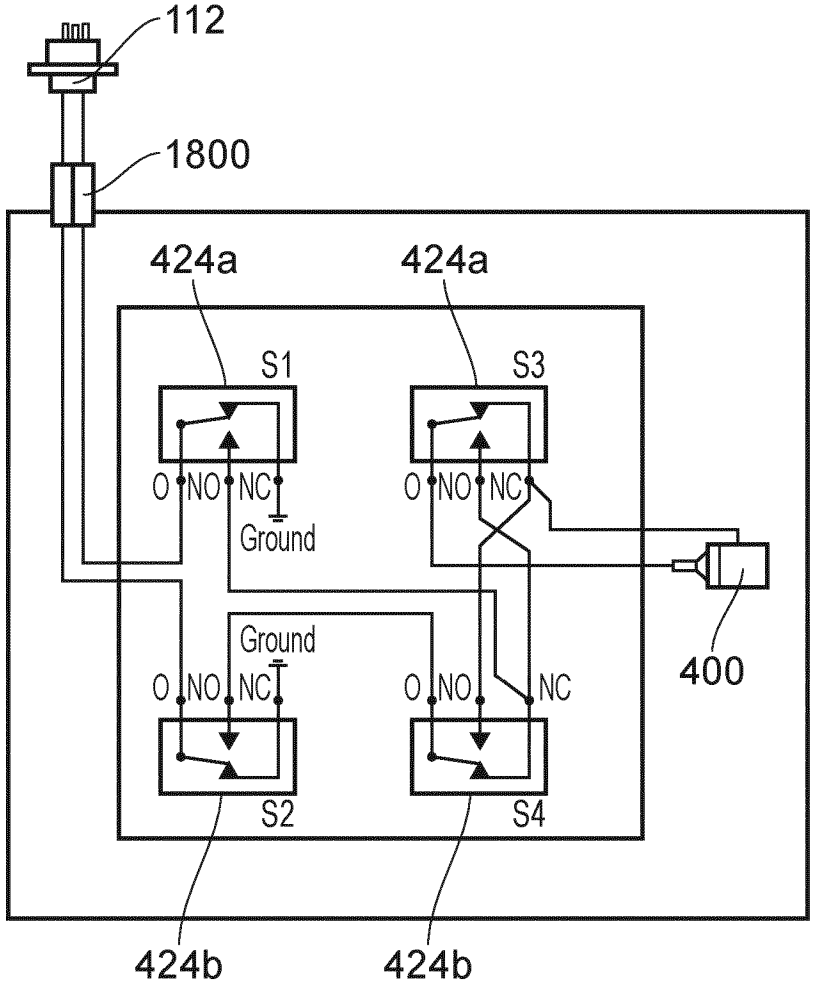

FIGS. 6(*a*) and 6(*b*) show an interrupter of the safety and arming unit shown in FIG. 1;

FIG. 7 shows a cross-sectional view A-A of the safety and arming unit of FIG. 1 in an unarmed configuration;

FIG. 8 shows a cross-sectional view B-B of the safety and arming unit of FIG. 1 in an unarmed configuration;

FIG. 9 shows a cross-sectional view C-C of the safety and arming unit of FIG. 1 in an unarmed configuration;

FIG. 10 shows a perspective cross-sectional view A-A of the interrupter and interlocks of the safety and arming unit of FIG. 1 in an unarmed configuration;

FIG. 11 shows a perspective cut-away view of a portion of the safety and arming unit shown in FIG. 1;

FIG. 12 shows a cross-sectional view A-A of the safety and arming unit of FIG. 1 in an armed configuration;

FIG. 13 shows a cross-sectional view B-B of the safety and arming unit of FIG. 1 in an armed configuration;

FIG. 14 shows a cross-sectional view A-A of the safety and arming unit of FIG. 1 in a sterilised configuration;

FIG. 15 shows a cross-sectional view B-B of the safety and arming unit of FIG. 1 in a sterilised configuration;

FIG. 16 shows a perspective view of a safety and arming unit coupled to a clearance charge;

FIG. 17 shows a schematic circuit diagram of the timer circuit for the safety and arming unit; and FIGS. 18(*a*) and 18(*b*) show a circuit diagram of safety switches in the firing circuit.

The safety and arming unit of the present disclosure is configured to be coupled to a clearance charge for clearing underwater ordnance, such as mines. The combination of the safety and arming unit, a clearance charge, means for attaching the clearance charge to the ordnance, a float (i.e. a positively buoyant body), and a remote initiation firing system is referred to herein as a Mine Neutralisation System (MNS). The MNS may be carried to the ordnance by a remotely operated vehicle (ROV), and then deployed. Before detonating the clearance charge, the ROV retreats to a safe distance. To prevent unintentional detonation, the safety and arming unit is provided with various safety and interlock features, as described below with reference to the appended figures. For ease of reference the safety and arming unit is referred to herein as SAU. The SAU provides for three configurations, safe, armed, and sterilised.

During transport by the ROV to the ordnance, the MNS is housed in a silo mounted to the ROV. Upon deployment, the float is released which releases an electric firing cable connecting the SAU and clearance charge to the remote initiation firing system. The remote initiation firing system is buoyant, or may simply be attached to the float, and so floats upwards to the water surface where it may receive an initiation signal (i.e. a firing signal). The SAU is configured such that only upon being in the armed configuration will a firing signal received from the remote initiation firing system trigger the detonator. It is noted that the SAU may be provided with a float transport pin, configured to lock the float to the SAU housing while being handled and mounted into the ROV silo. The float transport pin is removed before the ROV is launched.

Figure 2:
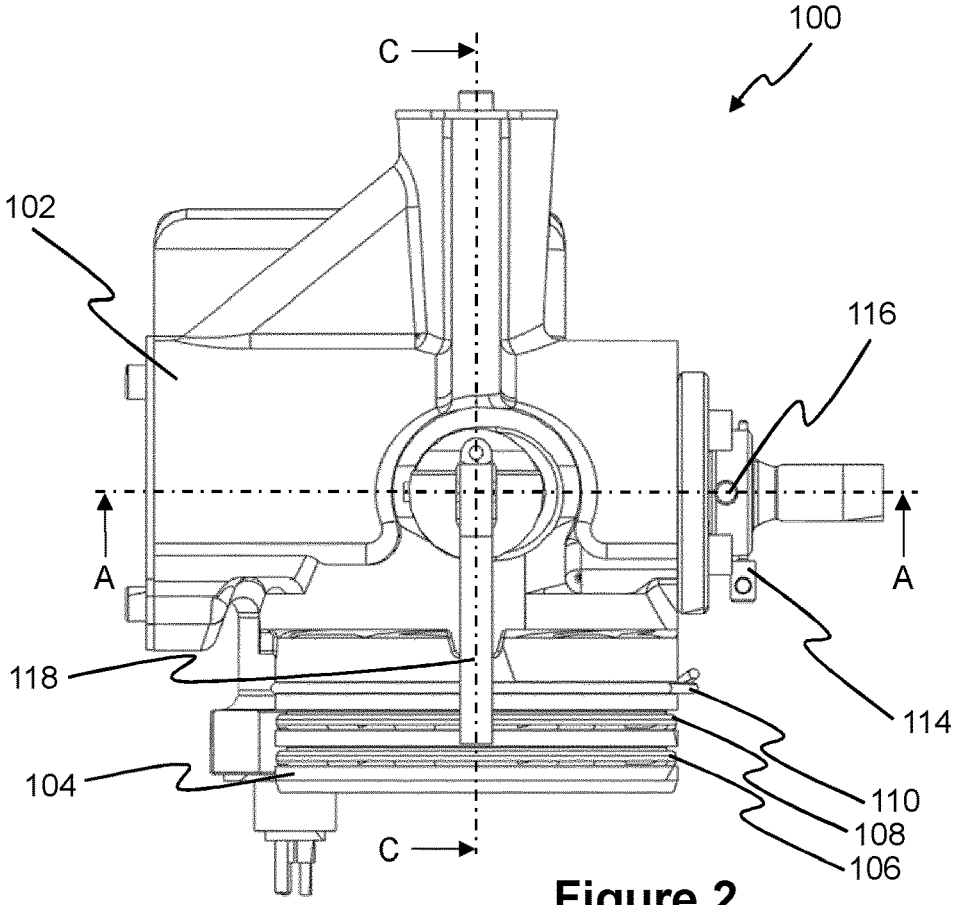
FIG. 2 shows a top view of the safety and arming unit shown in FIG. 1.
Figure 3:
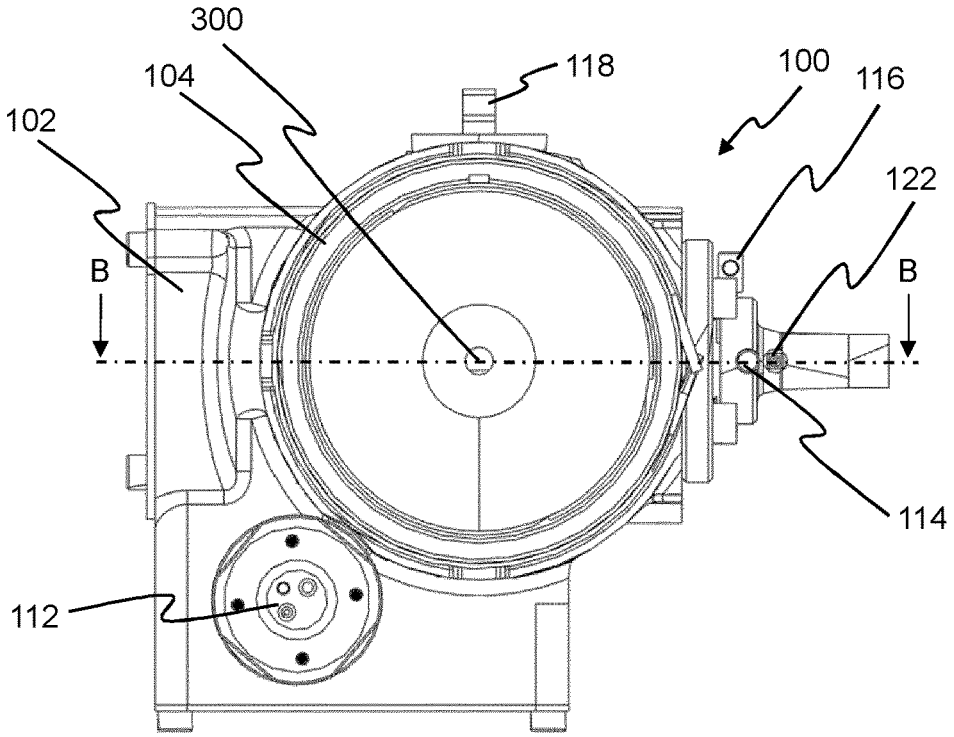
FIG. 3 shows a front view of the safety and arming unit shown in FIG. 1.

FIG. 1 shows a perspective view of a SAU 100 according to the present disclosure. FIG. 2 shows a top view of the SAU 100, and FIG. 3 shows a front view of the SAU 100. The SAU 100 comprises a housing 102 which houses an interrupter for providing a physical barrier in the firing chain between a detonator and a clearance charge. Details of the interrupter, and operation thereof, are provided below. The housing 102 comprises a cylindrical portion 104 configured to enable a clearance charge to be coupled thereto. In order to ensure no water ingress into the housing the cylindrical portion 104 comprises two annular grooves for receiving o-rings 106 and 108. A further annular groove is provided for receiving a cord 110 to coupled the clearance charge (not shown) to the SAU 100. A firing aperture 300 (shown in FIG. 3) is provided in the housing. The firing aperture 300 enables the detonator provided in the housing to detonate the clearance charge upon the interrupter being in the armed position. In effect, when the interrupter is not in the armed position, the firing aperture 300 is covered, interrupting the firing chain. The housing 102 is also provided with a connector 112 for connecting to a remote initiation firing system (not shown).

The interrupter is held in a safe, first, position by several independent safety features, some of which can be seen in FIG. 1. A removable transport pin 114 is shown, which is configured to be received in a through hole in the housing 102, and a corresponding through hole in the interrupter (not shown). When in place, the transport pin 114 prevents movement of the interrupter relative to the housing 102. The transport pin 114 is removed prior to releasing the ROV carrying the MNS from a support vessel. A removable float pin 116 is also shown, which, similarly to transport pin 114, is configured to be received in a through hole in the housing 102, and a corresponding through hole in the interrupter (not shown). When in place, the float pin 116 also prevents movement of the interrupter relative to the housing 102. The float pin 116 is attached to a float (not shown) by a flexible line, such as a cord. Upon deployment of the MNS by the ROV, the float is released, pulling the float pin 116 out of engagement with the housing 102.

A further safety feature can be seen in FIG. 1, the lever 118 is configured to act upon a slidable member (not shown) which in a first position physically locks the interrupter in the safe position and in a second position allows the interrupter to move to an armed position; this safety feature is described in further detail below. The lever 118 is releasably attached to the ROV by another flexible line, such as a lanyard. The lanyard is releasably attached to the lever 118 at notch 120.

The SAU 100 is also provided with an indicator system for visually indicating to a user which configuration the SAU is in. The hole 122 enables a portion of the interrupter, comprising indicia, to be visible from outside of the housing 102. The indicia on the interrupter provide a visible indicator as to the configuration of the SAU 100; in the safe state, a green "S" is visible, and in the armed state, a red "A" is visible. A further indicator is provided on the interrupter to indicate when the SAU 100 is in the sterilised state. The further, sterilised, indicator is a yellow portion which protrudes from hole 124 upon the SAU 100 being in the sterilised state.

Figure 4:
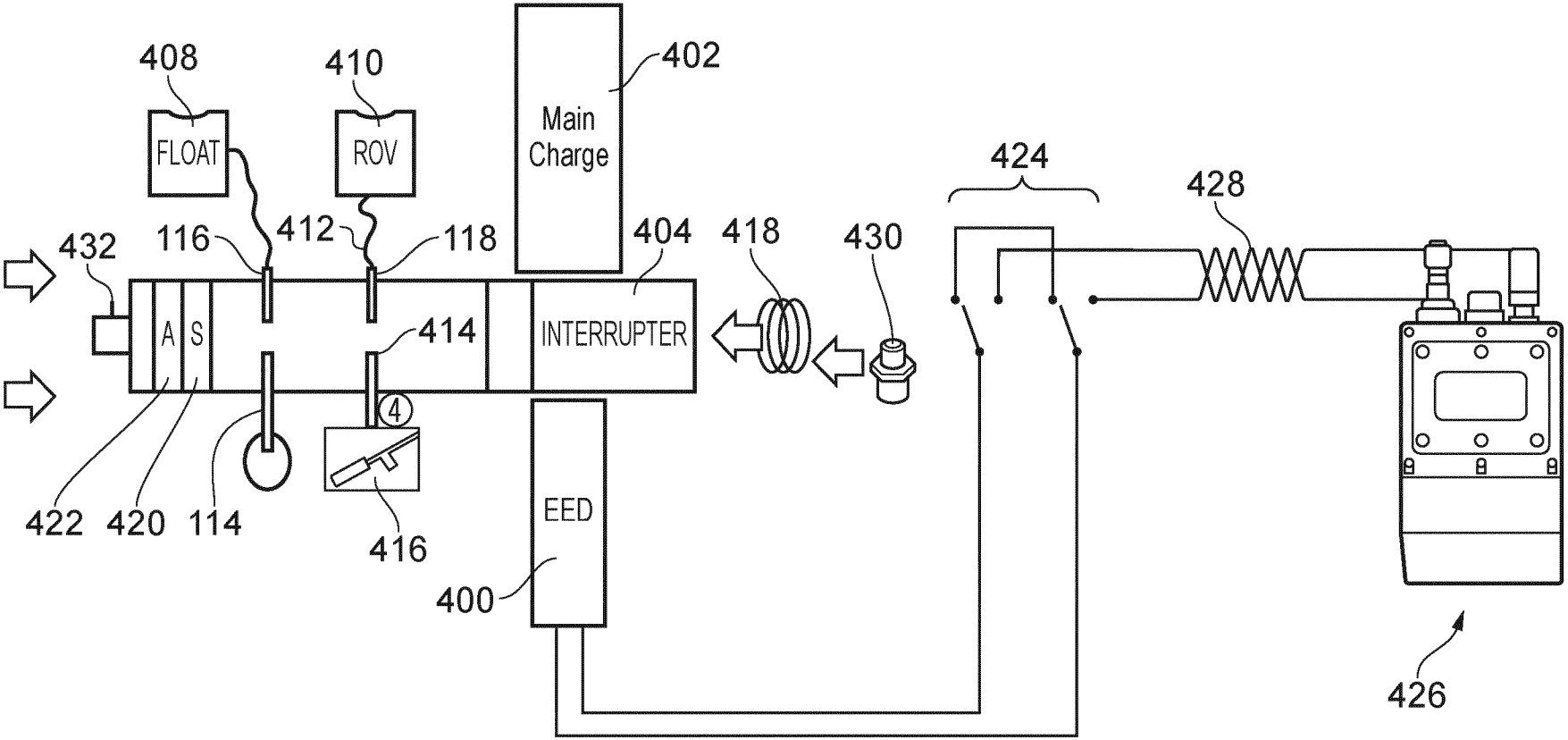
FIG. 4 shows a schematic representation of a safety and arming unit according to the present invention, coupled to an initiation signal receiver.

Before describing the details of the SAU 100, reference is made to FIG. 4, which is a schematic representation of the SAU 100, and a description of the operation is provided. As can now be seen a detonator 400 is axially aligned with the clearance charge 402, the interrupter 404 being disposed between the detonator 400 and the clearance charge 402. As shown the interrupter is in the "safe" state, and so a through hole 406 is out of alignment with the detonator 400 and the clearance charge 402. In the "armed" state, the interrupter is in a second position where the through hole 406 is aligned with the detonator 400 and the clearance charge 402 and so the firing chain is complete.

As described above, the interrupter 404 is prevented from moving to the "armed" state by various safety features, which are shown schematically in FIG. 4. The transport pin 114 is shown, along with the float pin 116 flexibly attached to a float 408, both of which must be removed before the interrupter 404 may move from the first, "safe", state to the second, "armed", state. The lever 118 is also depicted, and is releasably attached to an ROV 410 via lanyard 412. A final safety feature, in the form of a lock member 414 also prevents movement of the interrupter when that lock member 414 is in a first position. The lock member 414 is moved from the first position to a second, unlocked, position by an electrically actuated actuator 416; in this example, the actuator 416 is a protractor. The protractor is only actuated after a delay of 15 minutes from the lever 118 being moved to its second position, i.e. 15 minutes after deployment of the MNS by the ROV; any other suitable time delay may be used.

Once all four safety features have been activated, the interrupter 404 is slidable from the "safe" state to the "armed" state under the influence of an external water pressure of 3 mwc; the SAU 100 may be configured to be armed at any other suitable water depth. The spring 418 biases the interrupter towards the "safe" position and so as will be appreciated the depth of water required to arm the SAU is determined by the spring constant of spring 418. Upon movement of the interrupter 404 from the "safe" state to the "armed" state, the visual indicator 420 (a green "S") moves from visibility within the hole 122, and the visual indicator 422 (a red "A") becomes visible.

In addition, upon movement of the interrupter 404 from the "safe" state to the "armed" state, the electrical switches 424 are switched such that a remote initiation firing system 426 is electrically connected to the detonator 400 via a twisted pair cable 428; in this example, a bobbin of twisted pair cable of 415 m length is provided. Thus, upon receipt of a firing signal the remote initiation firing system sends a signal to the detonator 400 to detonate, thus initiating the clearance charge 402.

The remote initiation firing system 426 in one example is a Mini DFRD M3.0, manufactured by MAS Zengrange (NZ Ltd). The Mini-DRFD system is designed to remotely detonate munitions and explosives either by radio signals. The Mini-DRFD operates by using a UHF radio link from transmitter to receivers thereby over-coming the disadvantages associated with hardwire-based systems.

The detonator 400 has a low magnetic signature so as not to be detected by magnetic sensors in the ordnance. In addition, the detonator is sensitive enough to be fired from a Mas Zengrange Receiver 426 via the long firing cable 428, and sufficiently powerful to initiate the clearance charge without a lead or booster. The detonator 400 is preferably qualified according to STANAG 4560/AOP-43 and STANAG 4170. One such suitable detonator is L2A2, manufactured by Chemring and is in service with the UK MoD. The L2A2 contains 1.1 g PETN. The No Fire Current is 0.3 A max and the shelf life is 5 years.

The clearance charge 402, in one example, is a shaped charge with a copper cone to form a jet suitable for penetrating the ordnance. The pre-filled main charge is FPX R1M, a Plastic Bonded Explosive that is qualified according to STANAG 4170.

As mentioned above, deployment of the MNS by the ROV 410 starts an arming timer. In addition, a sterilisation timer is started, and after 6 hours if the SAU has not received a firing signal from the remote initiation firing system 426, a gas generator 430 is actuated to pressurise the housing and force the interrupter 404 against the external water pressure such that the interrupter is moved to a "sterilised" state. In this "sterilised" state the interrupter 404 is permanently locked by a latching lock on the interrupter which engages with the housing such that it cannot move back to the "armed" state. In addition, a sterilisation indicator 432 becomes visible out of hole 124.

Further structural features of the SAU 100 will now be described with reference to FIGS. 5 to 11; it is noted that in FIGS. 5 to 11 the SAU 100 is in the "safe" state.

Figure 5:
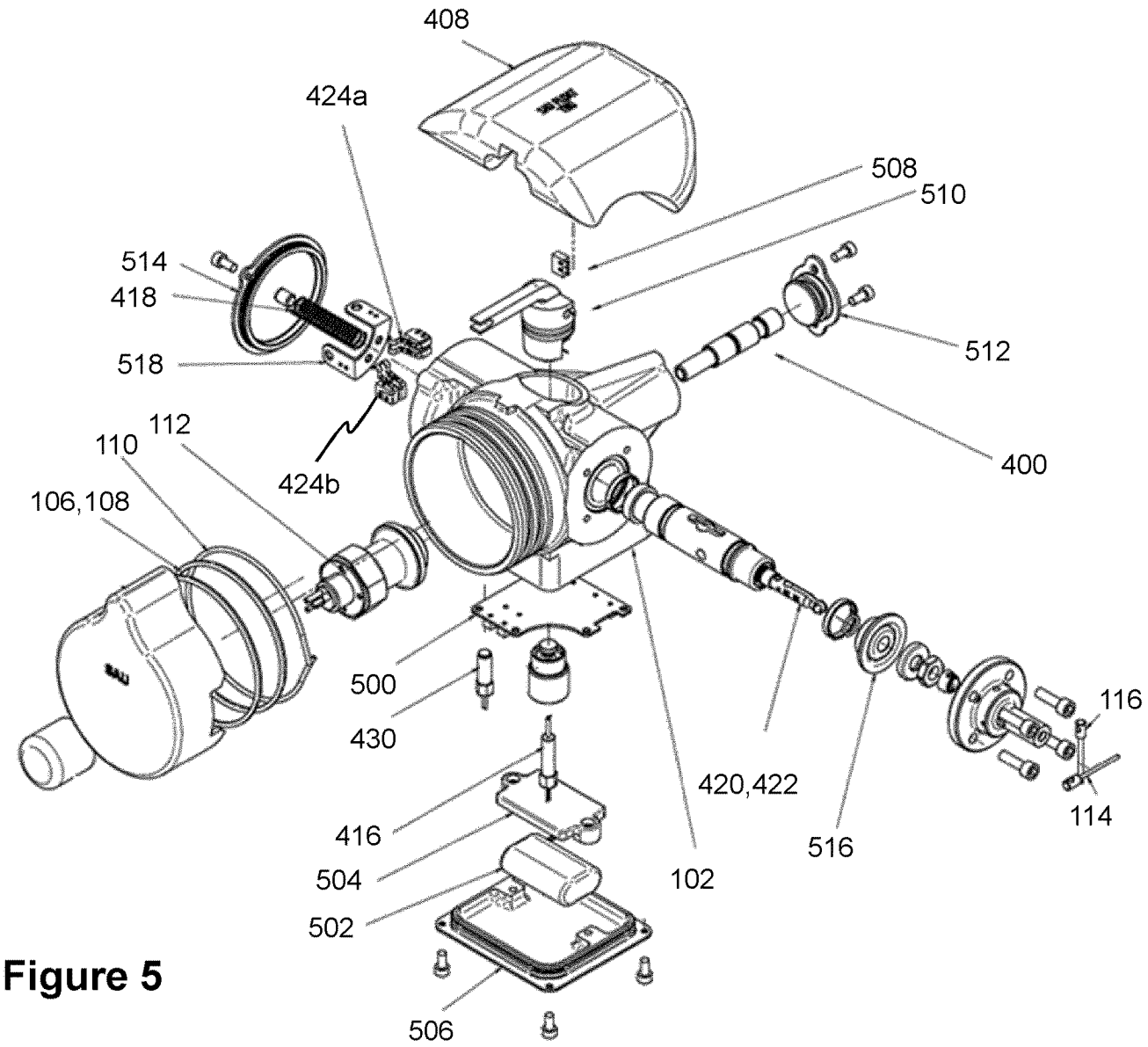
FIG. 5 shows an exploded view of the safety and arming unit shown in FIG. 1.

FIG. 5 shows an exploded view of the SAU 100. In addition to the features described above, which are provided with the same reference numerals throughout, the SAU 100 can be seen to comprise an electronic controller 500 provided with two micro-processors configured to independently run both of the arming timer and the sterilisation timer. The electronic controller 500 is powered by battery 502, which is retained within the housing 102 by retaining plate 504 which is secured to the cover 506. Cover 506 is provided with a seal to prevent the ingress of water into the housing 102.

A micro-switch 508 is provided in a sub-housing 510, which also rotatably supports the lever 118, and a lever lock member (not shown). As described above, moving the lever 118 to the second position acts to move the lock member to a second position and unlock the interrupter 404. At the same time, the micro-switch is activated.

In this example, the two microprocessors, type ATtiny24 and –44, are configured to operate in parallel, (OR-configuration). This configuration is chosen in order to maximise the functionality. Both micro-processors can individually fire the protractor 416 for arming and the gas generator 430 for sterilisation, hence increasing the function probability. When the micro-switch 508 is activated on deployment (the lanyard is pulled by the ROV) the timers in the processors start counting. To avoid resetting the counter to zero in case of a power failure, the counter value is stored in a non-volatile memory (the internal EEPROM) every two seconds and if there is a power interruption or a reset due to any reason when the timer is running, the count will continue from the last stored value. As described above, upon the arming timer reaching 15 minutes the protractor is triggered, and then upon the sterilisation timer reaching 6 hours the gas generator is triggered if the firing signal has not been received, or if the detonator did not function as intended. Further detail regarding the timing circuit is provided below with reference to FIG. 17.

Once the protractor 416 has been actuated, the interrupter 404 is free to move from the first, "safe," position to the second, "armed", position. However, it will only do so once the SAU is at least under the equivalent external pressure of 3 mwc. Various cover plates and seals are provided to prevent the ingress of water into the housing, and thus enable a pressure differential between an external portion of the interrupter at a first end thereof and an internal portion of the interrupter at a second end thereof. In addition to the seals described above, the detonator 400 is sealed within the housing by cover plate 512, the second end of the interrupter 404 upon which the spring 418 acts is sealed within a chamber by cover plate 514, and a flexible diaphragm 516 is provided at the first end of the interrupter 404 to enable the interrupter 404 to slide while a seal is maintained.

Upon the interrupter 404 sliding to the second, "armed", position the electrical switches 424 are activated. As can be seen, the switches 424 are provided in two sets, 424*a* and 424*b*, the switches being mounted orthogonal each other on mounting plate 518. Mounting the switches in this manner reduces the risk of activation of all switches due to vibration or impact forces. Further detail of the firing circuit is provided below with reference to FIGS. 18(*a*) and 18(*b*).

Looking now to FIGS. 6(*a*) and 6(*b*), further detail of the interrupter 404 can be seen. The interrupter 404 comprises annular bearing grooves 600 and 602 for receiving low friction annular bearings (not shown) so that the interrupter 404 is slidable within the housing 102. The interrupter 404 further comprises a first slot 604 having a notch 605. The lever lock member (not shown) has a corresponding projection at one end which engages with the notch 605 to prevent movement of the interrupter 404. Similarly, the slot 606 comprises a notch (not shown), and the lock member 414 comprises a projection at one end which engages with the notch to prevent movement of the interrupter 404. Upon movement of the lever lock member and the lock member 414 to their respective second positions, their projections pass further into the slot and no longer lock the interrupter 404 in position.

As described above, the interrupter is provided with a sterilisation lock 608 which is in the form of a sprung latch. Upon sterilisation the sterilisation lock 608 is forced through the hole 124, and the sprung latch engages with the external wall of the housing. In addition, an annular groove 610 is provided, which upon the interrupter 404 moving to the sterilised position, receives a sterilisation lock pin (not shown), the pin being resiliently biased towards the interrupter 404.

FIGS. 7 and 8 show cross-sectional views A-A and B-B respectively of the SAU 100; the orientation of the cross-sectional views are shown in FIGS. 2 and 3. FIG. 9 shows cross-sectional view C-C of the SAU 100, to which reference is now made. Looking in particular at the lever 118, it can be seen that end 900 is rotatably attached to the sub-housing 510 by shaft 902. Adjacent end 900, a cam surface 904 is provided, which is configured to act on an end of the lever lock member 906 upon the lever being moved to its second positon by the lanyard attached to the ROV as described above. To prevent unintentional movement of the lever lock member 906, a frangible, shear, pin is provided. The shear pin extends through the sub-housing 510 and the lever lock member perpendicular to the direction of movement of the lever lock member. Similarly, a shear pin 908 is provided which extends through a sub-housing 910 and the lock member 414 perpendicular to the direction of movement of the lock member 414. The sub-housing 910 is configured to receive the protractor 416 and lock member 414, and to be mounted in the housing 102.

Further detail of the lever lock member 906 are shown in FIG. 10. The lever lock member comprises a protrusion 1000 configured to activate switch 508 upon movement of the lever lock member 906 to its second position. As can be seen more clearly in FIG. 10, the lever lock member 906, at a second end comprises a projection in the form of a T-piece which is free to slide within a T-slot 1002 upon the lever lock member being in the second position. A similar such arrangement is provided at the second end of the lock member 414, which is free to slide within a T-slot 1004 upon the lock member 414 being in its second position.

Also shown more clearly in FIG. 10 is an elongate slot 1006. Adjacent a first end of the elongate slot 1006 is provided the through hole 406. The detonator 400 is arranged such that one end is provided within the elongate slot, such that upon movement of the interrupter 404 from the first position to the second position, the elongate slot 1006 slides relative to said detonator 400. In this way the detonator 400 can be provided as close as possible to the clearance charge while still providing a barrier sufficient to prevent initiation of the clearance charge upon actuation of the detonator while the SAU is in the safe state.

As described above, 6 hours after initiation of the sterilisation timer the gas generator 430 is actuated to place the SAU in the "sterilised" state. FIG. 11 shows a cross-sectional view taken through the centre-line of the gas generator. As can be seen, the gas generator 430 is sealed in a chamber 1100 within the housing 102. The chamber 1100 is provide adjacent an end of the interrupter 404.

Further detail will now be provided regarding the "armed" state, with reference to FIGS. 12 and 13. As described above, in order for the SAU to be in the "armed" state, the following actions must have occurred:

- the transport pin 114 must have been removed prior to launching the ROV;
- the float pin 116 must have been removed by the buoyancy force acting on the float, upon deployment of the MNS;
- the lever 118 must have been pulled by lanyard 412, such that the lever lock member is moved to its second position, having sheared the shear pin, whereby the second end is free to move within slot 1002;
- the arming timer must have been initiated by the activation of switch 508 by the lever lock member 906;
- the timer circuit must have reached 15 minutes from initiation of the arming timer, and subsequently actuated the protractor 416, such that the lock member 414 is moved to its second position, having sheared the shear pin 908, whereby the second end is free to move within slot 1004;
- the SAU must be within a water depth of at least equivalent pressure to 3 mwc, such that the interrupter is moved against the spring 418 to its second position, aligning the through hole 406 with the detonator 400 and clearance charge 402; and
- the interrupter 404 must have acted upon the two sets of switches 424*a* and 424*b* to electrically connect the detonator to the remote initiation firing system 426.

FIGS. 12 and 13 show the SAU in such an "armed" state, whereby all of the above actions have occurred, and the SAU is ready to receive a firing signal via the remote initiation firing system 426.

As described above, if the firing signal is not received within 6 hours, the timing circuit actuates the gas generator to sterilise the SAU. The "sterilised" state is shown in FIGS. 14 and 15.

FIG. 17 shows the circuit diagram for the electronic controller 500. As described above, the electronic controller 500 comprises two micro-processors 1700 and 1702, connected in parallel. As can be seen, upon activation of the switch 508, power is provided from the battery 502 (two 3.6 volt li-ion cells) via the low-dropout regulator 1703 to the micro-processors 1700 and 1702, which initiates the timers. Just before the arming timer reaches 15 minutes, the DC/DC-converter 1704 starts and generates 15 volts, the firing capacitor 1706 is charged and after a short delay, the field effect transistor (FET) opens and the protractor 416 is fired. The micro-processors provide a protractor fire signal three times to reduce the risk that the protractor is not actuated. The FET 1708 ensures that the firing capacitor 1706 is isolated after a firing, since there is no guarantee that the protractor or gas generator will be open-circuit after a firing and the thyristor 1710 must be commutated for the firing capacitor to recharge.

Similarly, just before the sterilisation timer reaches 6 hours, the DC/DC-converter 1704 starts and generates 15 volts, the firing capacitor 1706 is charged and after a short delay, the field effect transistor (FET) opens and the gas generator 430 is fired. The micro-processors provide a gas generator fire signal repeatedly until the battery 502 can no longer provide sufficient power to reduce the risk that the gas generator is not actuated. The FET 1708 ensures that the firing capacitor 1706 is isolated after a firing, since there is no guarantee that the protractor or gas generator will be open-circuit after a firing and the thyristor 1712 must be commutated for the firing capacitor to recharge.

All components of the electronic controller 500 are chosen for low magnetic signature, including the ferrite, switches, connectors and the battery.

To reduce the risk of a common cause batch failure, the two micro-processors 1700, 1702 are of different types with the only difference in memory size (ATtiny24 and ATtiny44), the software is however exactly the same in both devices. The software is basically a state machine with no nested interrupts. The two processors work in lock-step with a time difference of 24 seconds, to prevent any collision of signals. The processor oscillators are controlled by one 4 MHz crystal for each processor. The crystal accuracy is 50 ppm which results in a maximum error of ±1.08 second over 6 hours. If the micro-processor restarts after it has first been powered-up, the last time saved is read and the program continues from that time. In the event of a restart the maximum time error is 2 seconds+the time of the power outage.

Each micro-processor has its own external reset device that ensures that the processor starts in a controlled way after power-up and power-glitches, black-out or brown-out. The internal watchdog supervises the program flow, and in the case of a lock-up, it will restart the processor.

Finally, the firing circuit will be described with reference to FIGS. 18(*a*) and 18(*b*). FIG. 18(*a*) shows the electrical switches 424*a* and 424*b* in the "safe" configuration. Each set of electrical switches 424*a* and 424*b* comprise two separate switches, respectively S1 and S3, and S2 and S4. In FIG. 18(*a*), switch S3 is in a configuration which short-circuits the detonator 400, thus preventing firing, and switches S1 and S2 are in a configuration which ground the firing cable.

In FIG. 18(*b*) the electrical switches 424*a* and 424*b* are in the "armed" configuration. As can be seen, a first line of the firing cable is connected to the detonator by switches S1 and S3 in series, and a second line of the firing cable is connected to the detonator by switches S2 and S3 in series. A low-pass Pi-filter is provided to reduce the high frequency components in the firing signal. In this configuration, a firing signal provided by the remote initiation firing system is provided to the detonator via the firing cable and switches.

The embodiments and examples described above illustrate but do not limit the invention. It will be appreciated that other embodiments of the invention may be made and it is to be understood that the specific embodiments described herein are not intended to be limiting.

The invention claimed is:

1. A safety and arming unit for initiation of underwater charges, comprising:

a housing;

a detonator;

an interrupter slidable within the housing from a first position in which a firing chain from the detonator to a charge is interrupted, to a second position, in which the firing chain is complete;

a first member configured to cooperate with the housing and the interrupter to form a first interlock, wherein, upon the first member being in a first position, said interlock locks said interrupter in said first position, and upon the first member being in a second position, said interrupter is free to slide relative to said first member;

a second member configured to cooperate with the housing and the interrupter to form a second interlock, mechanically independent of said first interlock, wherein, upon the second member being in a first position, the interlock locks said interrupter in said first position, and upon the second member being in a second position, said interrupter is free to slide relative to said second member; and a plurality of electrical switches arranged in series, switchable from a first configuration in which the detonator is electrically isolated from a remote initiation firing system, to a second configuration in which the detonator is in electrical communication with a remote initiation firing system;

wherein, upon the first member being in the second position, and the second member being in the second position, the interrupter is slidable from the first position to the second position upon being subjected to an external water pressure of at least a predefined threshold value;

and wherein, upon the interrupter being in the second position, the interrupter acts on the plurality of electrical switches to switch said plurality of switches to said second configuration.

2. The safety and arming unit according to claim 1, further comprising a mechanical actuator configured to move said first member from said first position to said second position, preferably said mechanical actuator comprises a lever, pivoted about a fulcrum on said housing.

3. The safety and arming unit according to claim 2, further comprising a line having a first end releasably coupled to said mechanical actuator, and a second end configured to be coupled to a deployment device configured to deploy an underwater charge.

4. The safety and arming unit according to claim 1, wherein said first member is retained in said first position by a detent.

5. The safety and arming unit according to claim 1, further comprising an electrically actuated actuator configured to move said second member from said first position to said second position, preferably said electrically actuated actuator is a pyrotechnic piston actuator.

6. The safety and arming unit according to claim 5, further comprising at least one controller, the or each controller comprising an arming timer configured to output an arming signal after a predetermined period of time, wherein said arming timer is initiated upon the first member being moved to said second position, the arming signal being configured to actuate the electrically actuated actuator.

7. The safety and arming unit according to claim 5, wherein said second member is retained in said first position by a detent.

8. The safety and arming unit according to claim 1, further comprising a removable pin configured to engage with the housing and the interrupter to lock said interrupter in said first position, preferably the safety and arming unit further comprising a positively buoyant body flexibly coupled to said removable pin.

9. The safety and arming unit according to claim 1, wherein said plurality of electrical switches are configured in at least two sets, the sets being arranged orthogonally.

10. The safety and arming unit according to claim 1, wherein said interrupter is resiliently biased towards said first position.

11. The safety and arming unit according to claim 1, further comprising at least one removable transport pin configured to engage with the housing and the interrupter to lock said interrupter in said first position.

12. The safety and arming unit according to claim 1, further comprising a sterilisation system configured to permanently lock said interrupter in a sterilised position in which a firing chain from the detonator to a charge is interrupted, said sterilisation system comprising:

a sterilisation timer configured to initiate the sterilisation system after a predetermined period of time;

means to move the interrupter from said second position to said sterilised position; and a lock configured to cooperate with the housing and the interrupter to lock said interrupter in said sterilised position.

13. The safety and arming unit according to claim 12, wherein said means to move the interrupter comprises an electrically actuated gas generator.

14. The safety and arming unit according to claim 12, wherein said lock comprises a sprung clip, configured to engage with a through hole in the housing.

15. The safety and arming unit according to claim 1, further comprising:

first indicia configured to indicate that the interrupter is in the first position; and second indicia configured to indicate that the interrupter is in the second position.

16. The safety and arming unit according to claim 15, further comprising a sterilisation system configured to permanently lock said interrupter in a sterilised position in which a firing chain from the detonator to a charge is interrupted, said sterilisation system comprising:

a sterilisation timer configured to initiate the sterilisation system after a predetermined period of time;

means to move the interrupter from said second position to said sterilised position; and a lock configured to cooperate with the housing and the interrupter to lock said interrupter in said sterilised position, and the safety and arming unit further comprising third indicia configured to indicate that the interrupter is in the sterilised position.

* * * * *